US007059538B2

(12) United States Patent
Maruyama et al.

(10) Patent No.: US 7,059,538 B2
(45) Date of Patent: Jun. 13, 2006

(54) METHOD AND APPARATUS OF APPLYING FLUID

(75) Inventors: Teruo Maruyama, Hirakata (JP); Takashi Sonoda, Ritto (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 222 days.

(21) Appl. No.: 10/322,517

(22) Filed: Dec. 19, 2002

(65) Prior Publication Data

US 2004/0084549 A1 May 6, 2004

(30) Foreign Application Priority Data

Dec. 19, 2001 (JP) ..... 2001-385803

(51) Int. Cl.
*B05B 17/04* (2006.01)

(52) U.S. Cl. ..... 239/4; 239/102.2; 239/320

(58) Field of Classification Search ..... 239/4, 239/102.1, 102.2, 320; 310/311, 328, 323.01; 251/129.06

See application file for complete search history.

(56) References Cited

U.S. PATENT DOCUMENTS

| | | | | |
|---|---|---|---|---|
| 5,248,087 | A * | 9/1993 | Dressler | 239/102.2 |
| 5,855,323 | A * | 1/1999 | Yost et al. | 239/102.2 |
| 6,450,416 | B1 * | 9/2002 | Berg et al. | 239/4 |
| 6,508,196 | B1 * | 1/2003 | Hansson et al. | 239/4 |
| 6,558,127 | B1 | 5/2003 | Maruyama et al. | |
| 6,679,685 | B1 | 1/2004 | Maruyama et al. | |

FOREIGN PATENT DOCUMENTS

| | | |
|---|---|---|
| CN | 1312135 | 9/2001 |
| JP | 2002-1192 | 1/2002 |

* cited by examiner

*Primary Examiner*—Steven J. Ganey
(74) *Attorney, Agent, or Firm*—Wenderoth, Lind & Ponack, L.L.P.

(57) ABSTRACT

A method of applying fluid includes feeding fluid between two faces disposed with a gap maintained therebetween, and changing the gap between the two faces by driving an actuator for intermittently discharging the fluid filled in between the two faces. An input signal, in which a high-frequency component and a DC component are superimposed, is provided to drive the actuator in order to change the gap between the two faces, so that the fluid filled in between the two faces is intermittently discharged for fluid application.

4 Claims, 9 Drawing Sheets

METHOD AND APPARATUS OF APPLYING FLUID

BACKGROUND OF THE INVENTION

The present invention relates to an apparatus and a method of feeding fluid usable in production process in the field of electronic components, household electric appliances, and the like for quantitatively discharging various fluids including adhesives, solder pastes, fluorescent substances, greases, paints, hot melts, chemicals, and foods.

Fluid dispensers have been conventionally used in various fields. With recent needs of smaller and higher memory-density electronic components, technology for controlling discharge of a micro quantity of fluid materials with high accuracy and stability is being requested.

In the case of Surface Mount Technology (SMT) for example, in the trend of mounting with higher speed, smaller size, higher density, higher grade, and increased automation, requirements for the dispenser are outlined below:

① Increasing accuracy of an application quantity and minimizing an application quantity per applying operation;

③ Shortening discharge time, i.e., enabling interception and start of dispensation at high speed; and ④ Enabling dispensation of powder and granular material having high viscosity.

Conventionally for discharging a micro flow quantity of fluid, dispensers of air-pulse method, thread groove method, and micro pump method using electro- and magnetostrictive elements have come into practical use.

Among the above-described prior-art examples, widely used is the dispenser of air-pulse method as shown in FIG. 15, and the technology thereof is disclosed, for example, in "Automation Technology '93: 25th Volume No. 7". The dispenser of this method is for applying, like a pulse, a constant quantity of air fed from a constant-pressure source into a container 200 (cylinder) and for discharging a constant quantity of fluid corresponding to a rising part of pressure in the cylinder 200 through a nozzle 201.

The dispenser of the air-pulse method has a disadvantage of poor response.

The disadvantage is attributed to compressibility of air 202 enclosed in the cylinder and to resistance of a nozzle when an air pulse is passed through a narrow space. More specifically, in the case of the air-pulse method, time constant of hydraulic circuit expressed by T=RC, that is determined by cylinder capacity: C and nozzle resistance: R, is large, and therefore after application of an input pulse, time delay of, for example, about 0.07 to 0.1 sec. should be allowed before start of discharge.

In order to solve the above disadvantage of the air-pulse method, there has been put into practical use a dispenser equipped with a needle valve on an inlet portion of a discharge nozzle for opening and closing a discharge port by moving a small-diameter spool constituting the needle valve in axis direction at high speed.

In this case, however, when fluid is intercepted, a space between members that make relative movement becomes zero, and therefore powder whose average particle size is several microns to several tens of microns is mechanically subjected to compression action and destroyed. As a result, various failures occurs, which may make it difficult to apply the dispenser to application of adhesives, conductive pastes, and fluorescent substances containing powder, and the like.

Also for the same object, a dispenser of thread groove method, that is a viscosity pump, has been already put into practice. In the case of thread grove method, it becomes possible to select pump characteristics unlikely to depend on nozzle resistance, so that in the case of continuous application, a desirable result may be obtained. However, the thread grove method is not good at intermittent application because of the characteristics of the viscosity pump. Consequently in the conventional thread groove method, following measures are taken:

(1) An electromagnetic clutch is interposed between a motor and a pump shaft, and when discharge operation is turned ON/OFF, the electromagnetic clutch is connected or released; and (2) A DC servo motor is used to achieve quick rotation start or quick stop.

However, time constant of mechanical system determines responsibility in the both cases, which imparts restriction to high-speed intermittent operation. In terms of responsibility, the thread groove method is superior to the air-pulse method. However, the minimum time of about 0.05 sec. is a limit at best.

Further, rotation characteristics of the pump shaft at the time of transient response (at the time of rotation start and stop) have a number of uncertainty factors, so that strict control of flow quantity is difficult, and there is a limit of application accuracy.

A micro pump with use of stacked piezoelectric elements has been developed for the purpose of discharging a micro flow quantity of fluid. The micro pump is typically equipped with mechanical passive discharge valve and inlet valve.

However, it is extremely difficult for the pump composed of a spring and a ball for opening and closing the discharge valve and the inlet valve by pressure difference to perform intermittent discharge of rheological fluid having low fluidity and viscosity as high as tens of thousands to several hundred thousand centipoises with high accuracy of flow quantity and high speed (0.1 sec. or less).

In the fields of circuit formation, formation of electrodes and ribs for image tubes such as PDP and CRT, application of sealing materials for crystal liquid panels, and manufacturing process of optical disks and the like, where high accuracy and super-miniaturization are being pursued more and more in recent years, there are strong requests relating to microscopic application technology as shown below:

① After continuous application, application may be quickly stopped and after a short period of time, continuous application may be started swiftly. Accordingly, it is ideal that a flow quantity may be controlled with a pitch of 0.01 sec;

② Ability of discharging powder and granular material. For example, mechanical interception of a flow passage will not cause such trouble as compressive destruction of powder and clogging of the flow passage.

In order to meet various requests of recent years relating to application of a micro-flow quantity of high-viscosity fluid and powder and granular material, inventors of the present invention have filed a patent application titled "Apparatus and Method of Feeding Fluid" (patent application No. 2000-188899; unexamined patent publication No. 2002-1192) relating to an application means including the step of providing relative rectilinear motion and rotational motion to between a piston and a cylinder, providing a transportation means of fluid by the rotational motion, changing a relative gap between the fixed side and thus rotating side with use of the rectilinear motion, and thereby controlling a discharge quantity of fluid.

The present invention is a modification of the above proposal, and an object thereof is to provide a method and apparatus of applying fluid capable of increasing application accuracy with use of characteristics of each of intermittent application and continuous application by, for example, making intermittent application pseudo-continuous application or by switching intermittent application and continuous application in each step of fluid application process.

SUMMARY OF THE INVENTION

In order to achieve the aforementioned object, the present invention is constructed as follows.

According to a first aspect of the present invention, there is provided a method of applying fluid comprising of: feeding fluid by a fluid feeding apparatus to between two faces disposed with a gap maintained therebetween and changing the gap between the two faces by driving of an actuator for intermittently discharging the fluid filled in between the two faces, the method comprising:

giving an input signal in which a high-frequency component and a DC component are superimposed to drive the actuator for changing the gap between two faces; and thus intermittently discharging the fluid filled in between the two faces for fluid application.

According to a second aspect of the present invention, there is provided a method of applying fluid comprising the step of: feeding fluid by a fluid feeding apparatus to between two faces disposed with a gap maintained therebetween; changing the gap between the two faces by driving of an actuator for intermittently discharging the fluid filled in between the two faces; and applying the fluid while relatively moving a discharge port formed between the two faces and a substrate facing the discharge port, the method comprising:

when a velocity of the relative movement of the substrate and the discharge port is referred to as V, and a frequency for changing the gap between the two faces is referred to as f, selecting the velocity V and the frequency f so as to make a drawing line, that is applied on the substrate in the intermittent discharging, a pseudo-continuous line; and changing the gap between the two faces by driving an actuator so that the fluid filled in between the two faces is discharged for fluid application, thereby forming a pseudo-continuous drawing line.

According to a third aspect of the present invention, there is provided a method of applying fluid comprising of: feeding fluid by a fluid feeding apparatus to between two faces disposed with a gap maintained therebetween; and changing the gap between the two faces by driving of an actuator for intermittently discharging the fluid filled in between the two faces, the method comprising:

switching an intermittent discharge process for intermittently discharging the fluid filled in between the two faces by controlling driving of the actuator by a high frequency and thereby changing the gap by the frequency, and a continuous discharge process for continuously discharging the fluid by controlling driving of the actuator in a middle of the fluid application, with the intermittent discharging process and the continuous discharging process being provided.

According to a fourth aspect of the present invention, there is provided the method of applying fluid as defined in the third aspect, wherein in an initial point of a drawing line and a vicinity thereof in the fluid application, the continuous discharge process is switched to the intermittent discharge process.

According to a fifth aspect of the present invention, there is provided the method of applying fluid as defined in the third aspect, wherein in an end point of a drawing line and a vicinity thereof in the fluid application, the continuous discharge process is switched to the intermittent discharge process.

According to a sixth aspect of the present invention, there is provided the method of applying fluid as defined in the third aspect, wherein a drawing line formed by applying the fluid in the intermittent discharge process is a pseudo-continuous line.

According to a seventh aspect of the present invention, there is provided the method of applying fluid as defined in the sixth aspect, wherein when a time for switching from the intermittent discharge process to the continuous discharge process or a time for switching from continuous discharge process to the intermittent discharge process is expressed as $t=t_1$, an average flow quantity of the fluid discharged in the intermittent discharge process in a vicinity of $t=t_1$ is expressed as $Q=Q_1$, and an average flow quantity of the fluid discharged in the continuous discharge process is expressed as $Q=Q_2$, driving of the actuator is controlled so as to approximately conform the average flow quantity $Q_2$ with the average flow quantity $Q_1$ that is determined by increasing or decreasing a duty ratio, a pulse density of the pulse waveform, a frequency of the pulse waveform, or an amplitude of the pulse waveform when an input waveform of the high-frequency component in the intermittent discharge process is approximated to a pulse waveform.

According to an eighth aspect of the present invention, there is provided the method of applying fluid as defined in the first aspect, wherein when the gap between the two faces are changed by driving of the actuator, a shaft and a housing, having a discharge port, for housing the shaft are relatively rotated by a motor, and the fluid is discharged from the discharge port.

According to a ninth aspect of the present invention, there is provided the method of applying fluid as defined in the eighth aspect, wherein the gap between an end face of the shaft on a side of the discharge port and a face facing the end face is decreased by the actuator for intercepting the fluid, and after interception, fluid remained between the shaft and the housing on a side of the discharge port is sucked toward an opposite side of the discharge port by a dynamic seal formed on a relative movement face of the housing between the discharge port-side end face of the shaft and the face facing the end face.

According to a ninth aspect of the present invention, there is provided the method of applying fluid as defined in the eighth aspect, wherein the gap between an end face of the shaft on a side of the discharge port and a face facing the end face is decreased by the actuator for intercepting the fluid, and after interception, fluid remained between the shaft and the housing on a side of the discharge port is sucked toward an opposite side of the discharge port by a dynamic seal formed on a relative movement face of the housing between the discharge port-side end face of the shaft and the face facing the end face.

According to a 10th aspect of the present invention, there is provided the method of applying fluid as defined in the first aspect, wherein when the gap between the two faces are changed by driving of the actuator, a shaft of an electromagnetostrictive element is moved forward and backward in an axis direction toward the housing serving for housing the shaft and having the discharge port so as to discharge the fluid from the discharge port.

According to an 11th aspect of the present invention, there is provided the method of applying fluid as defined in the first aspect, wherein when a discharge time in the intermittent discharge process is expressed as T, an integral value of a discharge flow quantity of the fluid in a section of the discharge time T is expressed as Qsum, and an average discharge flow quantity Qave of the fluid is defined as Qave=Qsum/T, the actuator is driven so that the average discharge flow quantity Qave is set, by adjusting a duty ratio, a pulse density of the pulse waveform, a frequency of the pulse waveform, or an amplitude of the pulse waveform when an input waveform of the high-frequency component is approximated to a pulse waveform, or an envelope pattern of the high-frequency component in initial and end points of the fluid application.

According to a 12th aspect of the present invention, there is provided the method of applying fluid as defined in the first aspect, wherein the high-frequency component is in a range of from 50 Hz to 3000 Hz.

According to a 13th aspect of the present invention, there is provided an apparatus of applying fluid comprising:

a shaft;

a housing serving for housing the shaft that forms a pumping chamber with the shaft and having an inlet port and a discharge port of fluid for connecting the pumping chamber to outside;

an axial driving apparatus for giving an axial relative displacement between the shaft and the housing;

a liquid feeding apparatus for pressure-feeding the fluid flown into the pumping chamber to a discharge port side;

a control section for selecting and controlling an intermittent discharge operation for intermittently discharging the fluid filled in between the two faces by changing the gap between a discharge port-side end face of the shaft and a face facing the end face by the axial driving apparatus, and a continuous discharge operation for continuously discharging the fluid by the fluid feeding apparatus, based on an elapsed time after start of application or positional information about a top end of the discharge port, in a middle of the application.

According to a 14th aspect of the present invention, there is provided the apparatus of applying fluid as defined in the 13th aspect, wherein the axial driving apparatus comprises:

an electro-magnetostrictive element serving as the shaft and housed in the housing with a movable end as a front side and a fixed end as a rear side;

an apparatus for supporting the electro-magnetostrictive element in a relatively rotative manner to the housing and in a movable manner in axis direction; and an apparatus for giving rotation to the electro-magnetostrictive element.

According to a 15th aspect of the present invention, there is provided the apparatus of applying fluid as defined in the 13th aspect, wherein the fluid feeding apparatus is used as a master pump and the apparatus for intermittently discharging the fluid filled in between the two faces is used as a micro pump, the master pump and the micro pump being connected via a flow passage.

BRIEF DESCRIPTION OF THE DRAWINGS

These and other aspects and features of the present invention will become clear from the following description taken in conjunction with the preferred embodiments thereof with reference to the accompanying drawings, in which.

DETAILED DESCRIPTION OF THE PREFERRED EMBODIMENTS

Figure 1:
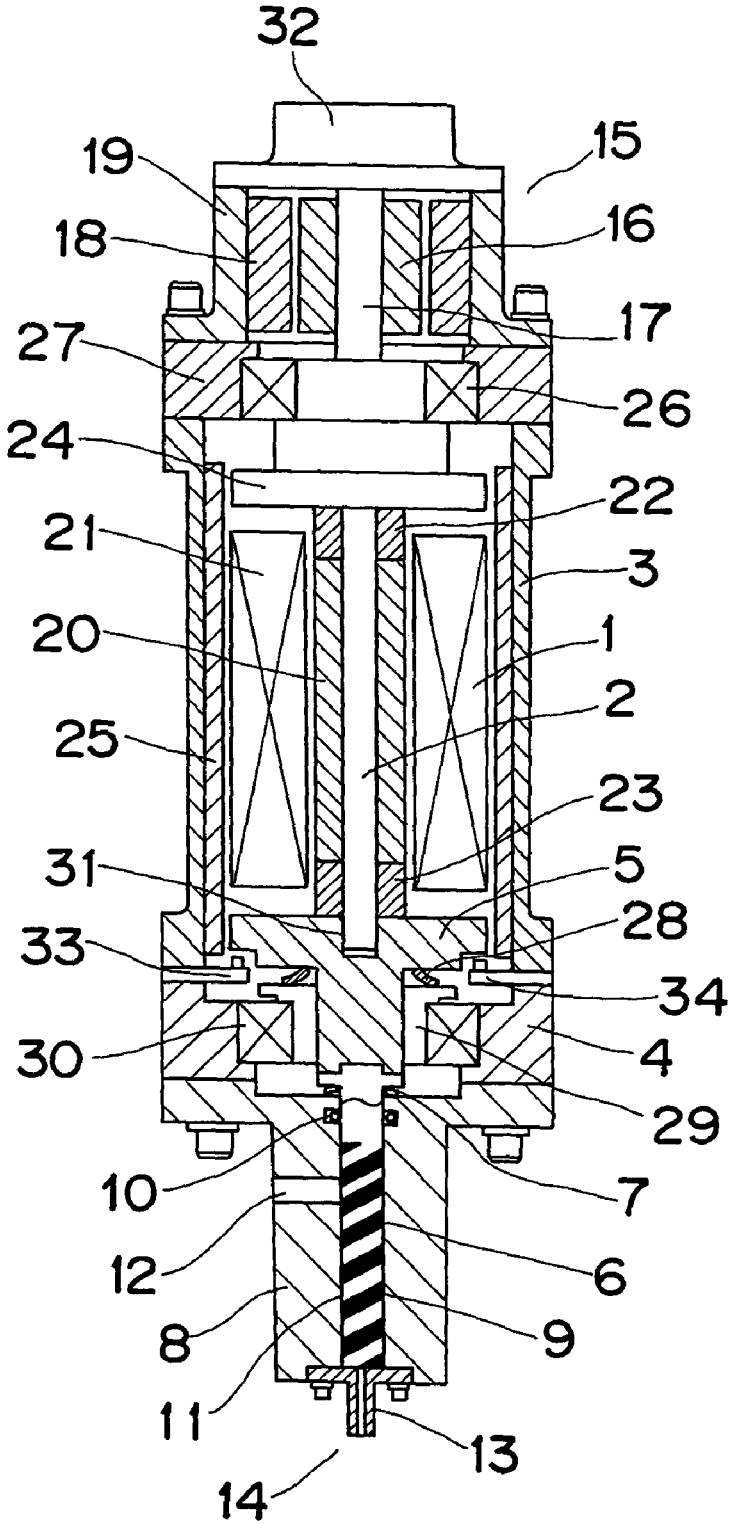
FIG. 1 is a cross sectional front view showing a dispenser constructed in accordance with a first embodiment of the present invention.

Before the description of the present invention proceeds, it is to be noted that like parts are designated by like reference numerals throughout the accompanying drawings.

Hereinbelow, embodiments of the present invention will be described in detail with reference to the drawings.

Description will be hereinbelow given of a first embodiment in which a method and an apparatus for applying fluid of the present invention are applied to a dispenser for surface mounting of electronic components, with reference to FIG. 1.

Reference numeral 1 denotes a first actuator. In the first embodiment, in order to intermittently feed a micro quantity of high-viscosity fluid at high velocity and with a high degree of accuracy, there is used a giant magnetostrictive element capable of providing high positioning accuracy, high responsibility, and a large development load.

Reference numeral 2 denotes a central shaft driven by the first actuator 1. The first actuator is housed in a housing 3. By a housing 4 disposed in the lower end portion of the housing 3, a front-side main shaft 5 is rotatably supported in a minutely movable manner in the direction of its axis. Reference numeral 6 denotes a piston (shaft) detachably mounted on the front-side main shaft 5 with bolts 7 and housed in a cylinder 8, reference numeral 9 denotes a thread groove (one example of the fluid feeding apparatus) formed on a relative movement face between the piston 6 and the cylinder 8 for force-feeding fluid to a discharge side, and reference numeral 10 denotes a fluid seal.

Between the piston 9 and the cylinder 8, there is formed a pumping chamber 11 for a thread groove pump for obtaining a pumping action from relative rotation of the thread groove 9 and a face facing the thread groove 9. Also on the cylinder 8, there is formed an inlet hole 12 connected to the pumping chamber 11. Reference numeral 13 denotes a discharge nozzle mounted on the lower end portion of the cylinder 8, and reference numeral 14 is a later-described discharge portion including the discharge nozzle 13.

Reference numeral 15 is a second actuator for effecting a relative rotational motion between the piston 6 and the cylinder 8. A motor rotor 16 is fixed to a rear-side main shaft 17, and a motor stator 18 is housed in a housing 19.

Reference numeral 20 denotes a cylindrical giant magnetostrictive rod composed of giant magnetostrictive elements, and reference numeral 21 denotes a magnetic coil for producing magnetic fields in a longitudinal direction of the giant magnetostrictive rod 20. Reference numerals 22 and 23 denote first and second permanent magnets for producing bias magnetic fields to the giant magnetostrictive rod 20, which are disposed such that the giant magnetostrictive rod 20 is interposed therebetween.

The first and second permanent magnets 22, 23 are for producing magnetic fields in advance to the giant magnetostrictive rod 20 for increasing a working point of the magnetic fields. This magnetic bias makes it possible to improve the linearity of giant magnetostrictive element relative to the intensity of the magnetic fields. Reference numeral 24 denotes a rear-side yoke of a magnetic circuit is disposed on the rear side of the giant magnetostrictive rod 20 and integrated with the rear-side main shaft 17. The above-stated front-side main shaft 5 also serves as a yoke member of a magnetic circuit and disposed on the front side of the giant magnetostrictive rod 20. Reference numeral 25 is a cylindrical yoke member disposed on an outer peripheral portion of the magnetic coil 21.

A closed-loop magnetic circuit for controlling extension and contraction of the giant magnetostrictive rod 20 is formed from: the giant magnetostrictive rod 20, the first permanent magnet 22, the rear-side yoke 24, the yoke member 25, the front-side main shaft 5, the second permanent magnet 23, and the giant magnetostrictive rod 20 in this order. It is noted that a nonmagnetic material is used for the central shaft 2 so as not to affect the magnetic circuit. More specifically, the giant magnetostrictive rod 20, the first and second permanent magnets 22, 23, and the magnetic coil 21 constitute a giant magnetostrictive actuator (first actuator 1) capable of controlling axial extension and contraction of the giant magnetostrictive rod 20 with the use of current applied to the magnetic coil 21.

Giant magnetostrictive materials are alloys of rare earth element and iron, and known examples thereof include $bFe_2$, $DyFe_2$, and $SmFe_2$. In recent years, practical application of these materials is being rapidly promoted.

An upper central shaft 17 is supported by a bearing 26 movably connected to a housing 27.

Reference numeral 28 denotes a bias spring mounted between the front-side main shaft 5 and a bearing sleeve 29. The bearing sleeve 29 is also rotatively supported by a bearing 30 relative to the housing 4. By an axial load provided by the bias spring 28, the giant magnetostrictive rod 20 is held in a state of being pressed by the upper and lower members 5, 24 via the first and second permanent magnets 22, 23. As a result, compressive stress in the axis direction is constantly applied to the giant magnetostrictive rod 20, which eliminates a disadvantage that the giant magnetostrictive element is susceptible to tensile stress when a repeated stress is generated.

The front-side main shaft 5, which is integrated with the piston 6 is housed in the bearing sleeve 29 that is restricted by the bearing 30 movably in the axis direction.

Rotational power of the central shaft 2 transmitted from the motor 15 is transmitted to the front-side main shaft 5 by a rotation transmission key 31 provided between the central shaft 2 and the front-side main shaft 5. The rotation transmission key 31 has an angular-shaped cross section which transmits the rotational power and becomes free in the axis direction (not shown).

With the above construction, rotational power of the motor 15 is transmitted only to the central shaft 2 and the front-side main shaft 5, and therefore twisted torque is not generated in the giant magnetostrictive element that is formed of a brittle material.

Reference numeral 32 denote an encoder for detecting rotational position information of the upper central shaft 17, and the encoder 32 is disposed on a top of the motor 15, which is a second actuator.

Reference numerals 33, 34 denote a first displacement sensor and a second displacement sensor for detecting an axial displacement of the front-side main shaft 5 (and the piston 6).

With the above construction, in the apparatus for applying fluid in the first embodiment of the present invention, the piston 6 of the pump enables simultaneous and independent control of rotational motion and rectilinear motion with minute displacement.

Further, in the embodiment, the giant magnetostrictive element is used as the first actuator, which enables noncontact feeding of power for making the rectilinear motion of the giant magnetostrictive rod 20 (and the piston 6) from outside.

Since input current inputted to the giant magnetostrictive element is in proportion to displacement, open-loop control without the displacement sensor enables control of axial positioning of the piston 6. However, performing feedback control with a position detecting apparatus provided as in the case of the present embodiment makes it possible to improve hysteresis property of the giant magnetostrictive element, thereby enabling a higher degree of accurate positioning.

In the first embodiment, use of the axial positioning function of the piston 6 makes it possible to arbitrarily control the size of the gap of the discharge-side thrust end face of the piston 6 while the steady rotating state of the piston 6 is maintained. Combining this function with the dynamic seal formed on the end face of the piston 6 enables interception and release of powder and granular material in a mechanically noncontact state in any section of the flow passage from the inlet hole 12 to the discharge nozzle 13.

Figure 2:
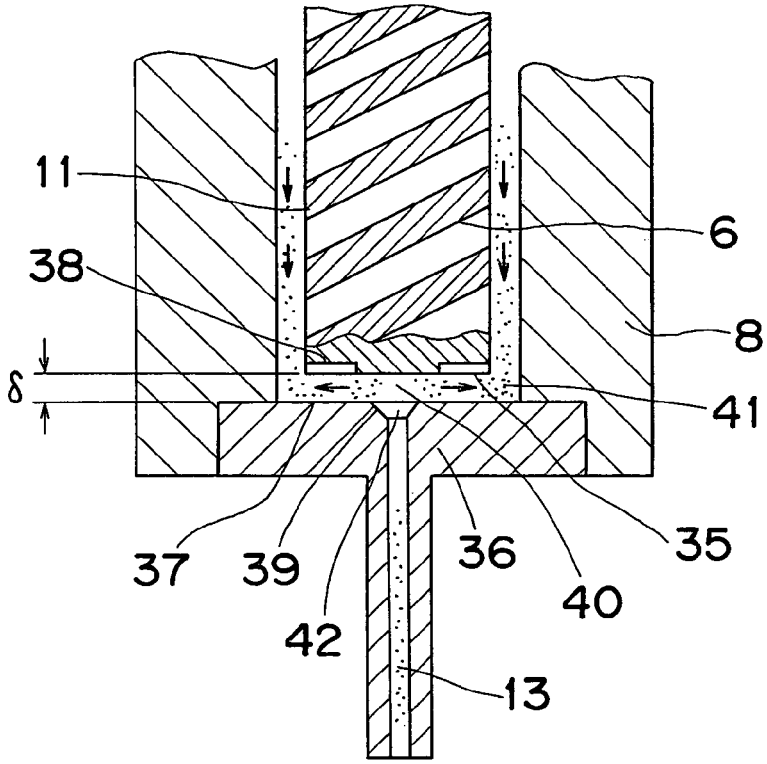
FIG. 2 is an enlarged cross sectional view showing a discharge portion of the first embodiment.

FIG. 2 is a detailed view of the discharge portion 14, in which reference numeral 35 denotes a discharge-side end face of the piston 6, and reference numeral 36 denotes a discharge plate fastened to the discharge-side end face of the cylinder 8. On a relative movement face between the discharge-side end face 35 of the piston and a confronting face 37 of the discharge plate, there is formed a thrust groove 38. In the central portion of the face 37 facing the thrust end face 35, there is formed an opening portion 39 of the discharge nozzle 13. The reference numerals 35 and 37 denote two faces disposed such that a narrow gap is maintained therebetween. Reference numeral 40 denotes an upstream side of the discharge nozzle positioned in the central portion of the opening portion 39, and pressure in this portion is defined in the present specification as discharge nozzle upstream-side pressure: Pn. Reference numeral 41 is a thrust groove-outer peripheral portion, and reference numeral 42 denotes a liquid pool portion.

The first embodiment of the present invention is for increasing application accuracy characteristics of each of intermittent application and continuous application by, for example, making intermittent application pseudo-continuous application or by switching intermittent application and continuous application in each step of fluid application process according to requested specifications of the fluid application process.

In the first embodiment described below, the piston is driven by the input waveform in which a high-frequency component is superimposed on a DC component for solving an issue about initial and end points in the continuous application.

Hereinbelow, the method of applying fluid in the first embodiment of the present invention will be described in the following order.

[1] Applying Formerly-Proposed Dispenser to Continuous Application

Issues in continuous application will be described.

[2] Applying Formerly-Proposed Dispenser to Intermittent Application

Characteristics of the case of applying the dispenser to intermittent application will be described.

[3] Application Method of the Present Invention

Driving method that solves the issues in continuous application will be described.

First, the method of theoretical analysis performed for obtaining the results of the above [1] to [3] cases will be described.

Fluid pressure in the case where viscous fluid is present in a narrow gap between plane faces disposed facing each other, and the gap changes with the lapse of time is obtained by solving the following equation (1) that is Reynolds equation having a term of squeeze action.

$$\frac{1}{r}\frac{\partial}{\partial r}\left(r\frac{\partial P^2}{\partial r}\right)=\frac{24\mu}{h^3}\frac{\partial(Ph)}{\partial t} \quad (1)$$

In the equation (1), P is the pressure, μ is a viscosity coefficient of the fluid, h is the gap between the facing faces, r is a radial position, and t is a time. The right side of the equation is a term to bring about the squeeze action effect that is generated when the gap is changed.

In the case where a rotational shaft is moved vertically for releasing and intercepting the fluid, a pressure change is generated between the end faces of the shaft. Hereinbelow, theoretical examination of the influence of the pressure change on discharge performance is provided. Accordingly, analysis was conducted for obtaining discharging pressure under the conditions of the viscosity of fluid: μ=10,000 cps, and the pressure of interface portion (thrust groove outer peripheral portion 41): Ps0=20 kg/cm$^2$ (1.96 MPa constant) when the discharge portion 14 is constituted under the conditions shown in Table 1 below.

TABLE 1

| Parameter | | Symbol | Spec. |
|---|---|---|---|
| Outer diameter of piston | | Dp | 6 mm |
| Gap between piston end face and facing face | Closed (Off) | δp | 10 μm |
| | Opened (Off) | | 30 μm |
| Inner diameter of discharge nozzle | | dn | 0.36 mm |
| Length of discharge nozzle | | ln | 6.5 mm |

The result of analysis obtained under the above conditions will be outlined below.

Figure 3:
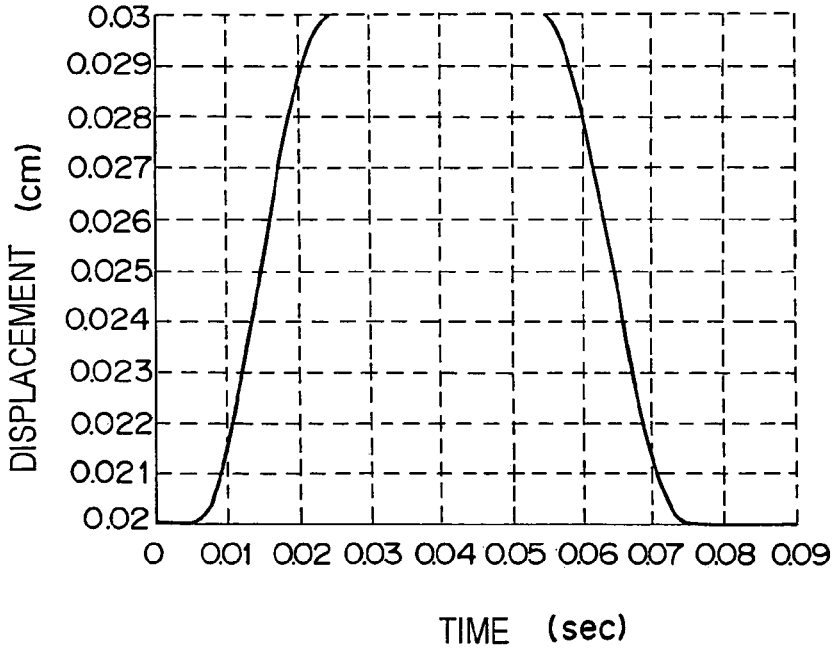
FIG. 3 is a view showing the relation between piston displacement and time in continuous application.

[1] Applying Formerly-Proposed Dispenser to Continuous Application (1) Displacement Curve of Output Shaft FIG. 3 shows the displacement curve of the piston 6. At the point of t=0.005 sec., the piston 6 starts rising (opening the discharge flow passage), stops at the point of t=0.025 sec., and maintains a constant position during the points t=0.025 to 0.055 sec. At the point of t=0.055 sec., the piston 6 starts falling (closing the discharge flow passage), and stops at the point of t=0.075 sec.

(2) Pressure Characteristics

Figure 4:
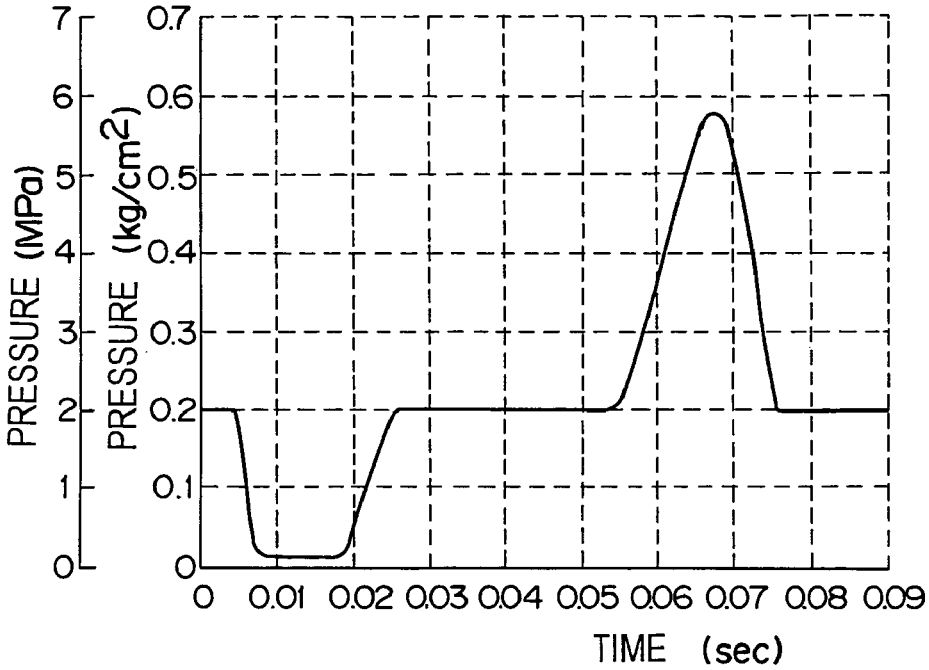
FIG. 4 is a graph showing the result of analyzing pressure on the upstream side of a discharge nozzle relative to time in the case of employing a formerly-proposed dispenser in a continuous application.

The result of analyzing the pressure at the upstream side of the discharge nozzle 40 is shown in FIG. 4.

Immediately after the piston 6 starts rising, the upstream-side pressure Pn of the discharge nozzle shows a steep decline.

The pressure falls steeply because fluid resistance in the centripetal direction is present between the outer peripheral portion and the central portion of a gap portion on the thrust end face generated by the rapid rise of the piston 6.

Because of this fluid resistance, fluid is not easily fed from the outer peripheral portion and the pressure rapidly falls so that it is not higher than the atmospheric pressure. In theory, this phenomenon is attributed to the effect that could be called reverse squeeze action expressed as dh/dt T>0 in the Reynolds equation (1).

Since fluid is not discharged from the discharge nozzle during generation of negative pressure (not higher than the air pressure), the condition for the fluid to start flowing-out: Pn>1.03 kg/cm$^2$ abs (not lower than the air pressure) is satisfied after discharge start instructions are issued and 0.02 sec. has elapsed.

As a result of the experiment, it was discovered that because of such reason as a part of application fluid usually filled in the flow passage of the discharge nozzle being replaced by air that flows in from the outlet of the discharge nozzle due to generation of the negative pressure, the start of flowing-out of the application fluid is further delayed.

After that, during the period of 0.025<t<0.055 sec., the state of continuous application is maintained.

When the piston 6 starts falling at the point of T=0.055 sec., the upstream-side pressure Pn of the discharge nozzle 13 rapidly rises. The rapid rise is attributed to the squeeze action generated in the state of dh/dt<0. Steep pressure rise at this point discharges excessive fluid right before the interception of discharge, and as a result, a fluid mass (thickening in the end portion) is generated.

From the above analysis result, it was discovered that in one cycle of release and interception of discharge in the case of using the dispenser, the upstream-side pressure of the discharge nozzle shows rapid falling and rapid rising. This reduces the application accuracy at the initial point and the end point of the fluid application.

Described above is the issue in the case of applying the dispenser formerly-proposed by the inventors of the present invention to the continuous application where fluid applying operation is started and terminated at a high velocity.

In the case of the dispensers operated by air-method, screw (thread) method, and plunger method widely used as before, it is difficult to form the initial point and the end point of a drawing line in the shape identical to the central portion of the line. One of the reasons thereof is that at the time of starting or intercepting outflow of fluid, a delay of time is generated until the velocity of the fluid reaches the constant state. Particularly in the case of high-viscosity fluid or the case of applying fluid at high velocity, the influence of the delay of time is remarkable, and more specifically, the influence appears in the form of thinning and breaking of the initial point portion of a drawing line or thickening and pooling of the fluid at the end point portion.

Figure 5:
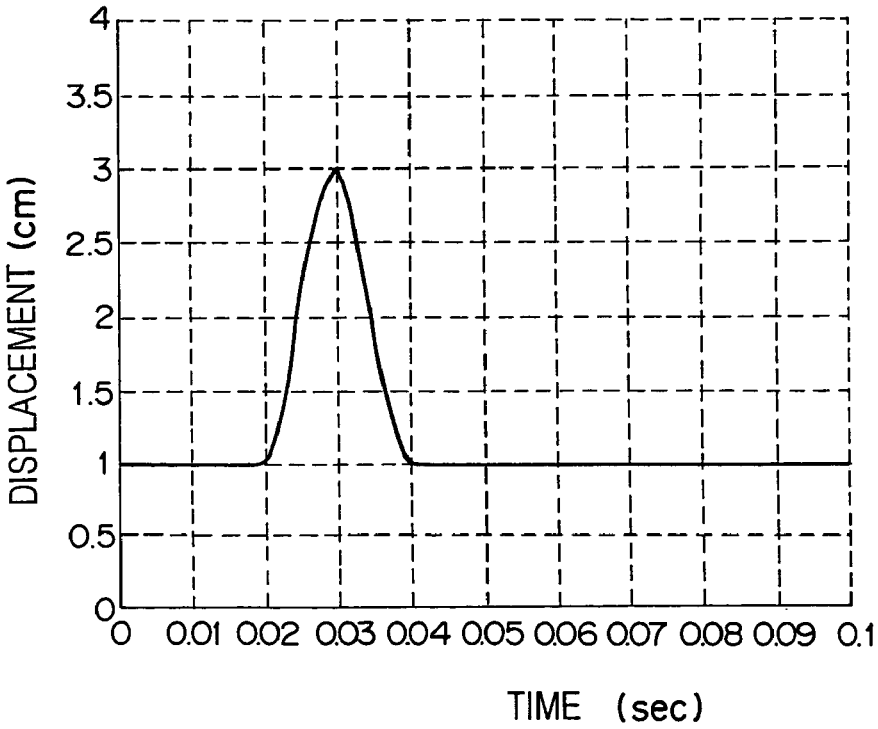
FIG. 5 is a view showing the relation between piston displacement and time in intermittent application.

[2] Applying Formerly-Proposed Dispenser to Intermittent Application (1) Displacement Curve of Each Output Shaft FIG. 5 shows displacement curve of the piston 6. At the point of t=0.02 sec., the piston 6 starts rising, and after reaching the peak at the point t=0.03 sec., the piston 6 starts falling and then stops at the point t=0.04 sec.

(2) Pressure Characteristics

Figure 6:
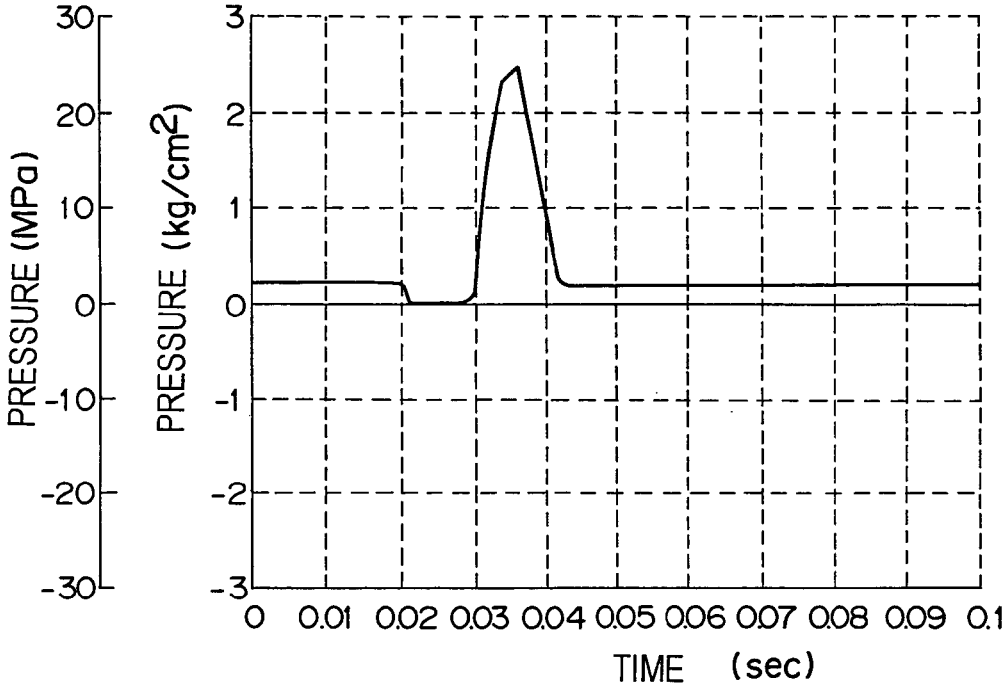
FIG. 6 is a graph showing a result of analyzing pressure on the upstream side of a discharge nozzle relative to time in the case of employing a formerly-proposed dispenser in an intermittent application.

The upstream-side pressure Pn of the discharge nozzle is shown in FIG. 6. In this case, immediately after the piston 6 starts rising at the point of t=0.02 sec., the upstream-side pressure Pn of the discharge nozzle steeply falls to the negative pressure side as in the case of the continuous application. However, as described above, actual fluid pressure does not become equal to Pn<0.0 kg/cm$^2$ abs.

Immediately after the steep fall of the pressure, the piston is lowered, so that the pressure rapidly rises again. In this case, different from the case of the continuous application, the upstream-side pressure of the discharge nozzle instantaneously changes from negative pressure to positive pressure. Consequently, even if the liquid present in the end of the discharge nozzle flows backward to the inside of the discharge nozzle, the fluid once sucked to the inside of the nozzle is again pressed back to the end-side of the nozzle by regenerated high pressure. Further, the peak value of the rapidly rising pressure is as extremely high as Pnmax=2.5 Kg/mm$^2$ (24.5 MPa). As described above, the pressure is obtained by the squeeze action that is a kind of the dynamic effect of fluid bearings.

In most cases, a fluid mass is repeatedly hit on the substrate while the discharge end and the substrate are being relatively moved. In this case, after termination of one cycle, the pressure shows rapid fall to the negative side again as shown in the drawing. More particularly, right before the start of the fluid application, the pressure becomes negative, and immediately after that, steep positive pressure is generated, and then is turned to negative pressure again. Because of the generation of this negative pressure, the fluid in the end of the discharge nozzle is sucked again to the inside of the nozzle, and separated from the fluid attached on the substrate.

More specifically, with the cycle consisting of negative pressure, steep positive pressure, and negative pressure, extremely sharp intermittent fluid application may be implemented.

[3] Application Method of the Present Invention

As described above, the examination of the above [1] and [2] cases clarified that in the case of applying the formerly-proposed dispenser to continuous application where fluid is released and intercepted at high velocity, there are issues relating to delay (thinning or generation of void portion) of the initial point of a drawing line at the time of starting fluid application, and an excess of flow quantity (generation of thickening or liquid pool) at the time of terminating fluid application. The present invention is invented by paying attention to the point that the disadvantage of the present dispenser in high-velocity continuous application turns out to be an advantage in intermittent application.

Hereinbelow, description will be given of the first embodiment with the issue of the initial and end points being solved. In this embodiment, the following two input waveforms are imparted for driving of the piston.

① Trapezoidal waveform (DC component) given in continuous application

② Input Waveform (high-frequency component) whose amplitude is gradually increased at the time of starting fluid application (at leading edge) and is adversely gradually attenuated at the time of terminating fluid application (at trailing edge).

More specifically, a waveform formed by superimposing the high-frequency component shown in ② on the DC component shown in ① is used to drive the piston for performing a pseudo continuous application.

Figure 7:
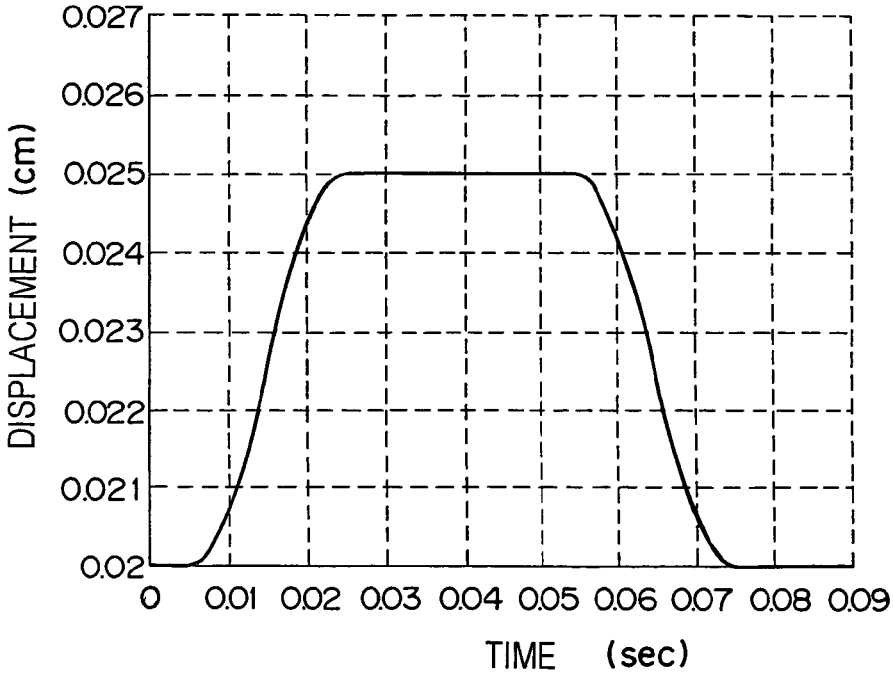
FIG. 7 is a view showing the relation between a DC component of piston displacement and time in an embodiment of the present invention.
Figure 8:
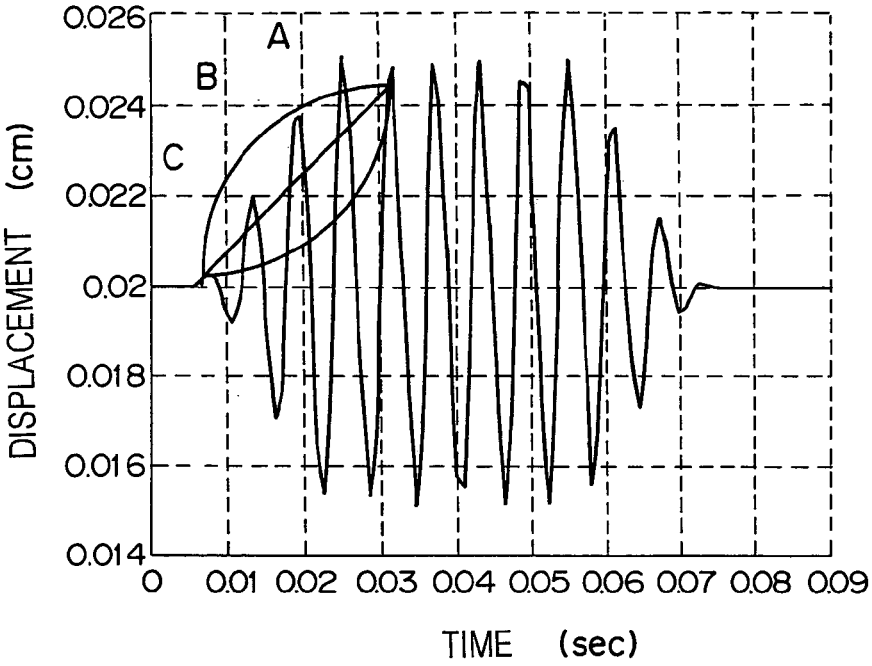
FIG. 8 is a view showing the relation between an AC component of piston displacement and time in an embodiment of the present invention.
Figure 9:
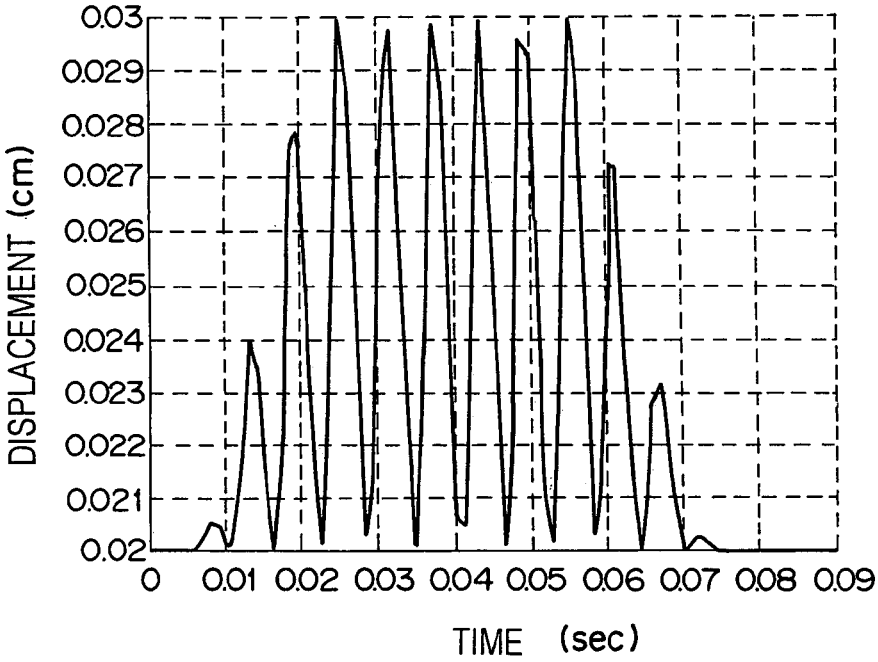
FIG. 9 is a view showing the relation between piston displacement and time in an embodiment of the present invention.

FIG. 7 shows a DC component of a basic input waveform of piston displacement to time, and FIG. 8 shows a high-frequency component thereof. FIG. 9 shows a waveform formed by superimposing these two inputs.

The basic input waveform of the piston displacement is formed based on a trapezoidal waveform having the 0.03 sec rising edge time and the 0.03 sec trailing edge time. In this embodiment, a giant magnetostrictive element for driving the piston has extremely high response on the order of $10^{-4}$ sec., which enables driving of the piston in faithful accordance with a given input waveform.

Figure 10:
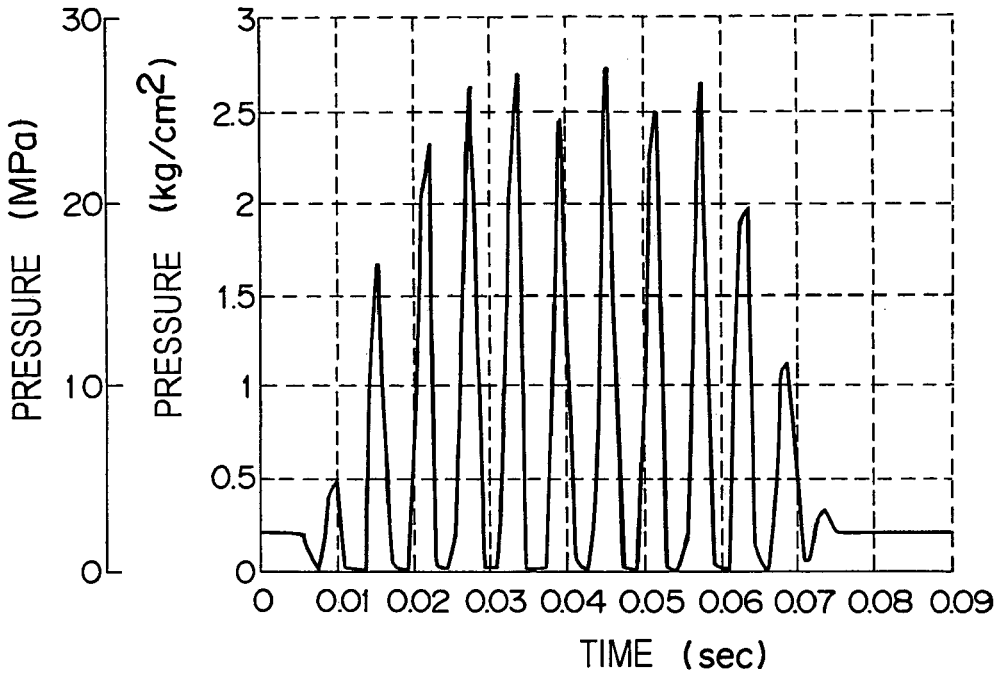
FIG. 10 is a graph showing a result of analyzing pressure on the upstream side of a discharge nozzle relative to time in an embodiment of the present invention.

FIG. 10 shows a result of analyzing upstream-side pressure of the discharge nozzle in the case of solving the equation (1) with the input waveform of the piston in FIG. 9 being given under the conditions shown in Table 1.

In the case of intermittent application, higher frequency f for driving the piston or smaller relative velocity v between a discharge head and an application target plane connects applied fluid masses on the substrate more to each other, and so the intermittent application approximates a continuous application infinitely. Appropriate setting of the frequency f and the relative velocity V makes the intermittent application a "pseudo continuous application".

Comparison will be made between the analysis result (FIG. 4) of the continuous discharge where a trapezoidal waveform (DC component only) is provided as the input waveform of the piston and the analysis result (FIG. 10) of the pseudo continuous discharge of the present embodiment.

In the case of the trapezoidal waveform input, pressure is sharply dropped at the time of starting discharge and is largely increased at the end of discharge due to squeeze pressure, so that the pressure waveform on the initial-point side becomes quite asymmetric to the pressure waveform on the end-point side. In the case of the pseudo continuous application, an absolute value (peak value) of each pressure waveform itself is high, and therefore the envelope of the initial-point side is almost symmetric to that of the end-point side.

In an experiment of pseudo continuous fluid application under the same conditions as the above analysis, the issues relating to the initial point and the end point of applying operation as well as the lack, thinning, generation of a liquid mass, and thickening of a drawing line were solved, and therefore a sufficiently high-accuracy continuous line could be drawn.

Further, for eliminating flow quantity difference between the initial point and the end point of the drawing line (difference in line width and thickness) and smoothly connecting the central portion to the initial point and the end point of the drawing line, it was an effective measure to change the following conditions at the rising edge, trailing edge, and the central portion corresponding to various fluid application conditions in respective process to which this fluid application is applied.

① (Duty ratio when an input waveform of the high-frequency component is approximated to a pulse waveform (ratio of ON time to pulse cycle)

② Pulse density (or frequency)

③ Amplitude of high-frequency component

④ Envelope pattern of the high-frequency component in the initial and end points (the form connecting A, B, C of FIG. 8 or a rectangular waveform form are acceptable)

It is noted that when a specified discharge time in the intermittent discharge process is expressed as T, an integral value of a discharge flow quantity in the section of the time T (total flow quantity) is expressed as Qsum, and an average discharge flow quantity Qave may be defined as Qave=Qsum/T.

The pseudo continuous application in high-velocity intermittent application by the present dispenser is characterized in that the accuracy of the applying line at the time of starting and terminating fluid application is not susceptible to the influence of the position of meniscus (interface) of the fluid that is present inside the discharge nozzle or in the end of the discharge nozzle.

For example, examination will be given of the following two cases with reference to FIGS. 11A and 11B.

Figure 11A:
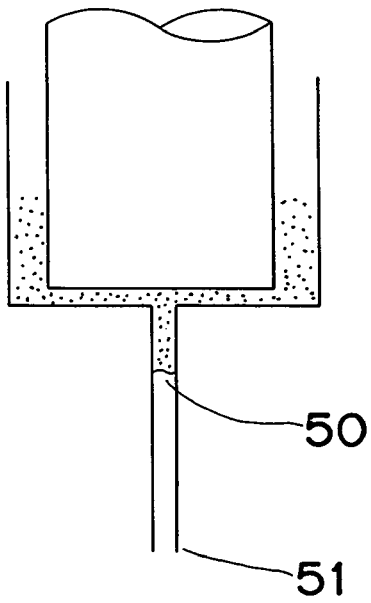
FIGS. 11A and 11B are views each showing the meniscus state of fluid in a discharge nozzle.

① Fluid meniscus 50 is positioned in the middle portion of the discharge nozzle, and air enters in between the meniscus 50 and a nozzle end 51 (FIG. 11A).

Figure 11B:
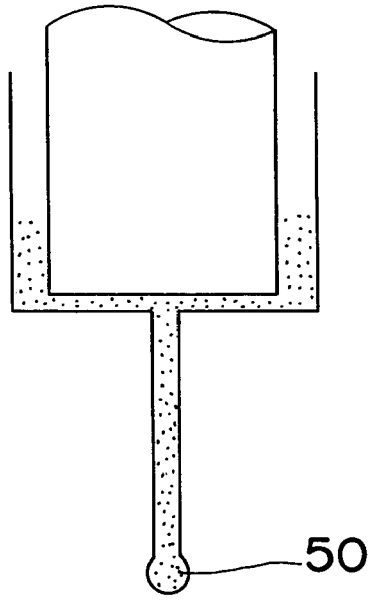

② The fluid meniscus 50 is positioned in the end of the discharge nozzle, and takes the shape of a fluid mass (FIG. 11B).

When the continuous application is started with use of the conventional dispenser under the above condition ①, a drawing line was not accurately drawn immediately after the start point, and thinning and breaking was generated on the initial-point portion of an applying line. Contrary to this, in the case of the pseudo continuous application, a smooth drawing line, without breaking, could be drawn. The reason thereof is explained below.

When a time taken for the meniscus 50, that is the top end of the discharge fluid, to reach the nozzle end 51 is T1, a flow quantity is Q1, a nozzle cross sectional area is A1, and a length of air entering portion is L, a velocity V1 is expressed as V1=Q1/A1, T1=L/V1. Consequently, until a time t becomes t>T1, creation of a drawing line in the normal state is not attainable. Similarly, in the case of the pseudo continuous application, each item is designated by symbol Q2, A2 V2, and T2. It is clear that V1<<V2 and T1>>T2. More specifically, contrary to the conventional dispenser, the dispenser in the pseudo continuous application is able to start drawing a line immediately after the start of an operation. As repeatedly described, this is because steep pressure rise due to squeeze pressure sends out application fluid to the nozzle end at high velocity.

Also, when the continuous application is started with the use of the conventional dispenser under the above condition ②, actual visual observation proved the following. When a fluid mass has already grown quite large, the fluid mass falls down on the substrate with a drop at the time of starting operation, and remarkably damages drawing accuracy. When a fluid mass is still small in the starting stage, the fluid mass gradually grows as the drawing operation proceeds. The size of the fluid mass becomes constant in a certain stage, until which the drawing line gains slight difference in line width.

In the case of performing the pseudo continuous application that is the embodiment of the present invention in the state of the above ②, the above issue could be solved. This is because, even if a fluid mass is present in the discharge nozzle end at the time of starting, the fluid mass is once sucked to the inside of the nozzle and separated from the fluid attached onto the substrate by negative pressure generated at the time of starting the intermittent application.

More specifically, by one cycle of the intermittent application, an unstable initial state of the nozzle end is eliminated, and in the following intermittent cycles, the same initial state is repeatedly reproduced.

Further, as described before, a thrust dynamic seal, if provided on the upstream side of the discharge nozzle, has an action of again sucking the fluid remaining after interception in the discharge nozzle 13 to the inside of the pump, which makes it possible to further eliminate the negative influence of the fluid mass on the application accuracy.

The average flow quantity in the case of the intermittent application may be adjusted, as described above, by selecting at least any one of: a pulse density of a pulse waveform when an input waveform of the high-frequency component is approximated to the pulse waveform; an amplitude of the piston (pulse waveform); an intermittent driving frequency (frequency of the pulse waveform), a ratio of width of time ΔT when the pulse is in ON state to time T of one cycle (duty ratio), and the like. More specifically, these parameters are selected so as to conform a drawing line of the pseudo continuous application with a drawing line of the continuous application in terms of the line width and thickness.

An advantage of making the intermittent application the pseudo continuous application with use of the dispenser of the present invention is the point that the average flow quantity is changeable at extremely high velocity. As already described with reference to FIGS. 5 to 6, this is because in the case of the intermittent application only, the cycle consisting of negative pressure, steep positive pressure, and negative pressure enables implementation of extremely sharp intermittent fluid application, and therefore in the case of the pseudo continuous application that is an aggregation of the intermittent fluid application, similar high-response fluid application may be implemented.

The condition of performing the pseudo continuous application of the intermittently-discharged fluid is determined by the relation between "intermittent driving frequency: f" and "relative velocity between the discharge head and the application target plane in drawing line direction: V". Higher driving frequency f increases the velocity V, thereby providing an advantage in terms of the production tact (cycle time). Consequently, if an electro-magnetostrictive element such as giant magnetostrictive elements and piezoelectric elements having responsibility of 103 to 104 Hz is used for driving of the piston, sufficiently large relative velocity in drawing line direction: V may be obtained because of the high responsibility. Therefore, the pseudo continuous drawing with high productivity becomes possible.

Since input current supplied to the giant magnetostrictive element is in proportion to displacement, open-loop control without a displacement sensor enables control of axial positioning of the piston 6. However, performing feedback control with the position detecting apparatus provided as in the case of the present embodiment makes it possible to improve, the hysteresis property of the giant magnetostrictive element, thereby enabling more accurate positioning.

Instead of using an electro-magnetostrictive element such as giant magnetostrictive elements and piezoelectric elements, there may be applied an actuator such as an electromagnetic solenoid. In this case, responsibility becomes one digit lower than that of the electro-magnetostrictive element, though restriction of stroke is drastically relaxed.

Hereinbelow, a second embodiment of the present invention will be described.

Figure 12:
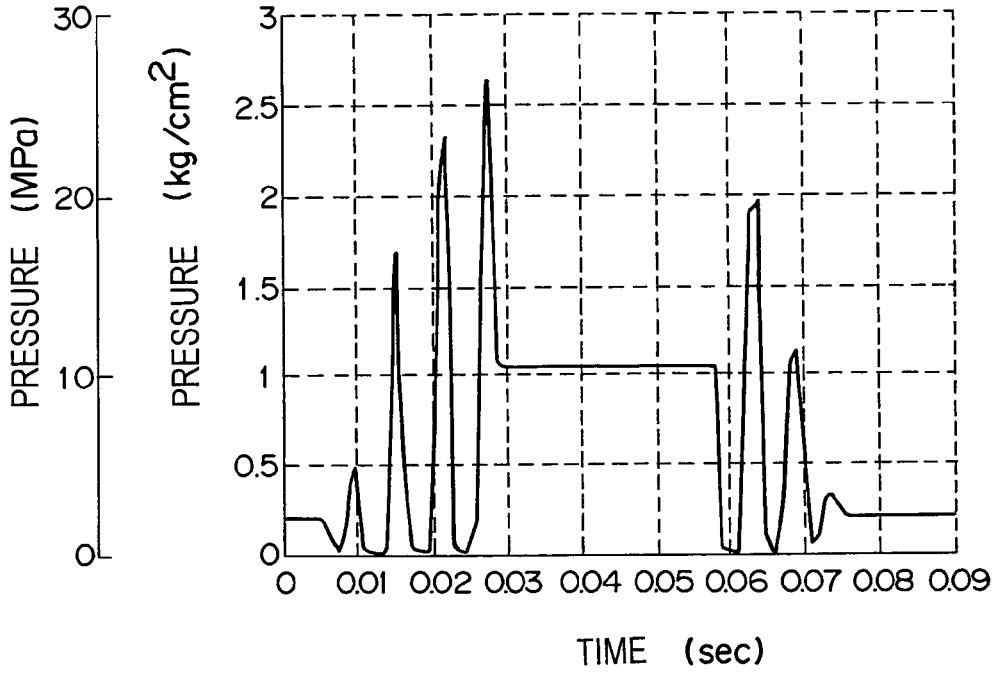
FIG. 12 is a graph showing a result of analyzing pressure on the upstream side of a discharge nozzle relative to time in a second embodiment of the present invention.

This embodiment is for performing intermittent discharge in the transient state i.e., at the time of starting applying operation in the fluid application process, switching to continuous discharge in the stage of entering the constant state, and then switching again to the intermittent application at the end of the applying operation. FIG. 12 shows a result of analyzing the upstream-side pressure of the discharge nozzle.

This method makes it possible to eliminate thinning and breaking of an initial point of an applying line as well as eliminate thickening and generation of a fluid mass at an end point of the applying line This method also brings about an advantage to the application tact because there is no restriction of relative velocity V in the section of continuous application. In the embodiment, the input waveform of a piston displacement curve is based on, as a basic waveform, a trapezoidal waveform having a rising edge time and a trailing edge time of 0.015 to 0.025 sec., respectively, and is formed by superimposing an intermittent waveform on the rising edge portion and the trailing edge portion of this basic waveform. More particularly, (1) High-velocity intermittent application is performed during the period of t=0.005 sec. to t=0.03 sec. after the start of the applying operation.

(2) At the point of t=0.03 sec. after a lapse of specified time, the movement of the piston is terminated and the intermittent application is switched to continuous application.

In this state, sufficiently large relative velocity V between the discharge head and the application target plane is attainable.

(3) At the point of t=0.06 sec. before termination of the applying operation, the continuous application is switched again to the pseudo continuous application consisting of high-velocity intermittent application.

Instead of switching to the intermittent discharge at the time of starting and terminating of the application as shown in the above embodiment, the intermittent discharge may be selected in the middle of drawing a continuous line or only in a certain limited section. For example, in the manufacturing process of liquid crystal panels, there is required a process of drawing a rectangular closed-loop for painting a seal material. Conventionally, in the case of using an air-method dispenser for example, there is an issue that the speed of a discharge nozzle and a face facing the nozzle is rapidly changed at corner portions of the rectangle, and therefore uniform line thickness is not attainable.

By applying the present invention to this process, the above issue can be solved. More specifically, only when the discharge nozzle runs the corner, the continuous discharge may be changed to the intermittent discharge.

In the case where the velocity of the discharge nozzle and the face facing the nozzle in the fluid application direction is extremely fast, or in the case where frequency of intermittent driving is limited, pseudo continuous discharge may be achieved by the following method. More specifically, a small-diameter long pipe is attached to the discharge side as a time delay element, and a discharge nozzle is provided at the top end of the pipe. This structure provides the effect of a low-pass filter, which enables pseudo continuous discharge even with low frequency (not shown).

Use of the present invention enables free selection of intermittent application, pseudo continuous application, and continuous application in the middle of the application process. For example, it may be operated such that after intermittent application of dotting, pseudo continuous application is performed with slight change in a flow quantity (width and thickness of an applying line), and then the pseudo continuous application is switched to the continuous application with the use of a high-velocity stage.

Hereinbelow, a third embodiment of the present invention will be described.

Figure 13:
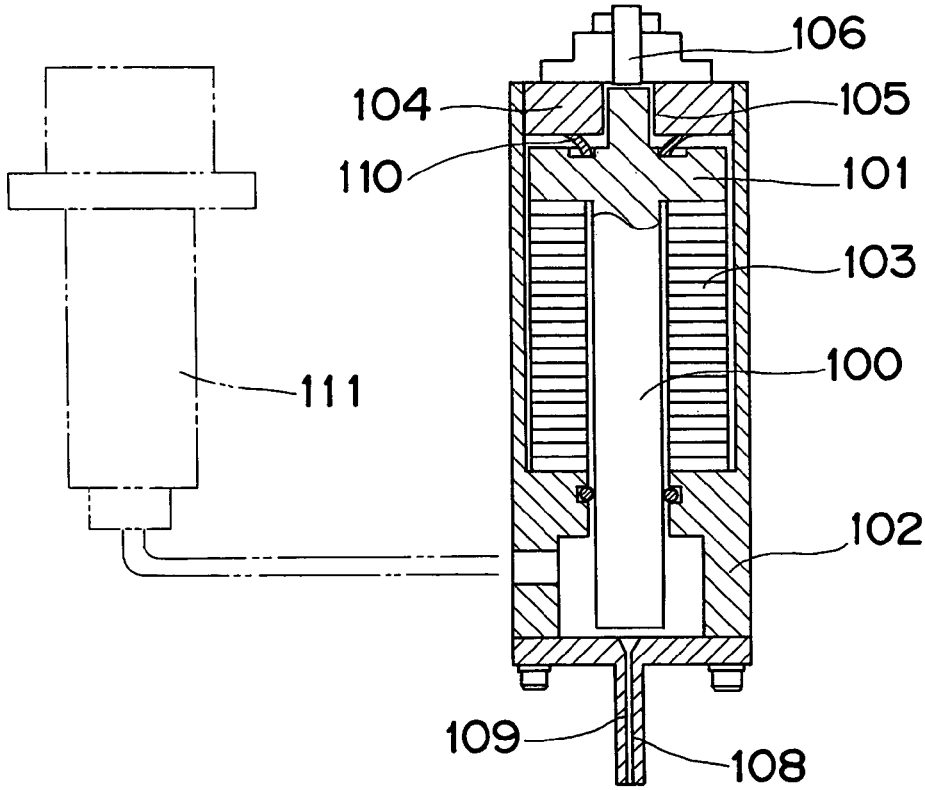
FIG. 13 is a cross sectional front view showing a dispenser constructed in accordance with a third embodiment of the present invention.

The present embodiment is for solving the issue relating to the initial and end points in the continuous application with an extremely simple constitution by combining a micro pump (tentative name) that generates intermittent discharge pressure and a master pump (tentative name) that is "the source of fluid pressure" provided outside. FIG. 13 shows a micro pump driven by stacked piezoelectric elements.

Reference numeral 100 denotes a piston, 101 denotes a flange portion provided on the upper portion of the piston, 102 denotes a cylinder, 103 denotes stacked piezoelectric elements provided in the state of being interposed in between the flange portion and the cylinder 53, 104 denotes an upper cover, 105 denotes a bearing portion formed on the upper cover 104 for supporting the piston 100, and 106 denotes a displacement sensor for detecting an axial direction portion of the piston 50.

Reference numeral 107 denotes an inlet port formed on the discharge side of the cylinder, 108 denotes a discharge portion, 109 denotes a discharge nozzle, and 110 denotes a bias spring disposed in between the flange portion 101 and the upper cover 104 for pressurizing the piezoelectric elements 103.

In the case of the stacked piezoelectric element, a stroke relative to the same length is small compared to the case of the giant magnetostrictive element. However, since an electromagnetic coil is unnecessary, its outer diameter may be decreased. This brings about an advantage in attempting to design multi-dispenser or multi-nozzle apparatus.

On the upstream side of the inlet port 107 of the micro pump, there is disposed a master pump 111 (shown with a broken line).

In the embodiment, a thread-groove pump is used as the master pump. The thread-groove pump is characterized in that ① powder and granular material may be transported from the inlet port to the discharge port in a mechanically noncontact state, ② a flow quantity may be changed by number of rotation, ③ constant flow characteristic is obtainable, ④ shearing force by rotation is imparted to powder and granular material with poor flow property so that the viscosity of the powder and granular material may be decreased, and the like.

The master pump applicable to the present invention includes a gear pump, a trochoid pump, and a mono pump in addition to the thread-groove pump. Further, an air source provided outside may be used instead of the pump to feed fluorescent substance to the micro dispenser by air pressure, which enables considerable simplification of the entire apparatus of applying fluid.

In the above-described embodiment of the present invention, an electro-magnetostrictive element enables high-frequency intermittent driving, so that pseudo continuous application is fulfilled with high productivity as described before. Conventionally, the air-method and the thread groove method have limited responsibility, and therefore frequency for dotting is at best about 20 Herz. As a result of evaluation of the dispenser of the embodiment, 50 Herz or more intermittent driving was obtained, which achieved pseudo continuous application having sufficiently high quality compared to the application by a dispenser of the conventional method. An upper limit of the frequency was around 3000 Herz due to the limit of transfer characteristics of a mechanical portion driven by the electro-magnetostrictive element.

Figure 14A:
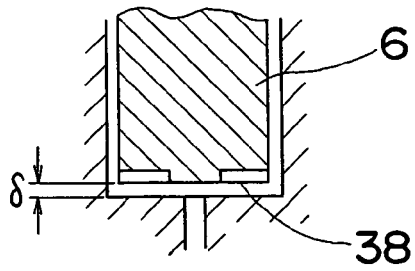
FIGS. 14A, 14B, and 14C are graphs each showing the relation between generated pressure of a thrust dynamic seal and a gap.
Figure 14B:
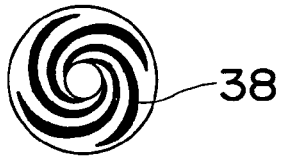

Hereinbelow, referring to FIGS. 14A, 14B, and 14C, supplementary description will be given of the radial groove pump and the thrust dynamic seal described before with reference to FIGS. 1 and 2.

The radial groove 11 described before is well known as a spiral groove dynamic bearing, and is also used as a thread groove pump. Pumping pressure generated by the thread groove pump is determined by a turning angle velocity, an outer diameter of the shaft, a groove depth, a groove angle, a groove width, a ridge width, and the like.

The thread groove pump by the radial groove 11 is not an indispensable element of the present invention. However, it has such characteristics that the flow quantity may be changed by the number of rotation, constant flow characteristic is obtainable, and shearing force due to the rotation is imparted to powder and granular material having poor fluid property so that the viscosity of the powder and granular material may be decreased as described before.

The thrust groove 38 is similarly known as a thrust dynamic bearing. The seal pressure that the thrust bearing can generate is also determined by a turning angle velocity, inner and outer diameters of the thrust bearing, a groove depth, a groove angle, a groove width, a ridge width, and the like (refer to FIGS. 14A and 14B).

Figure 14C:
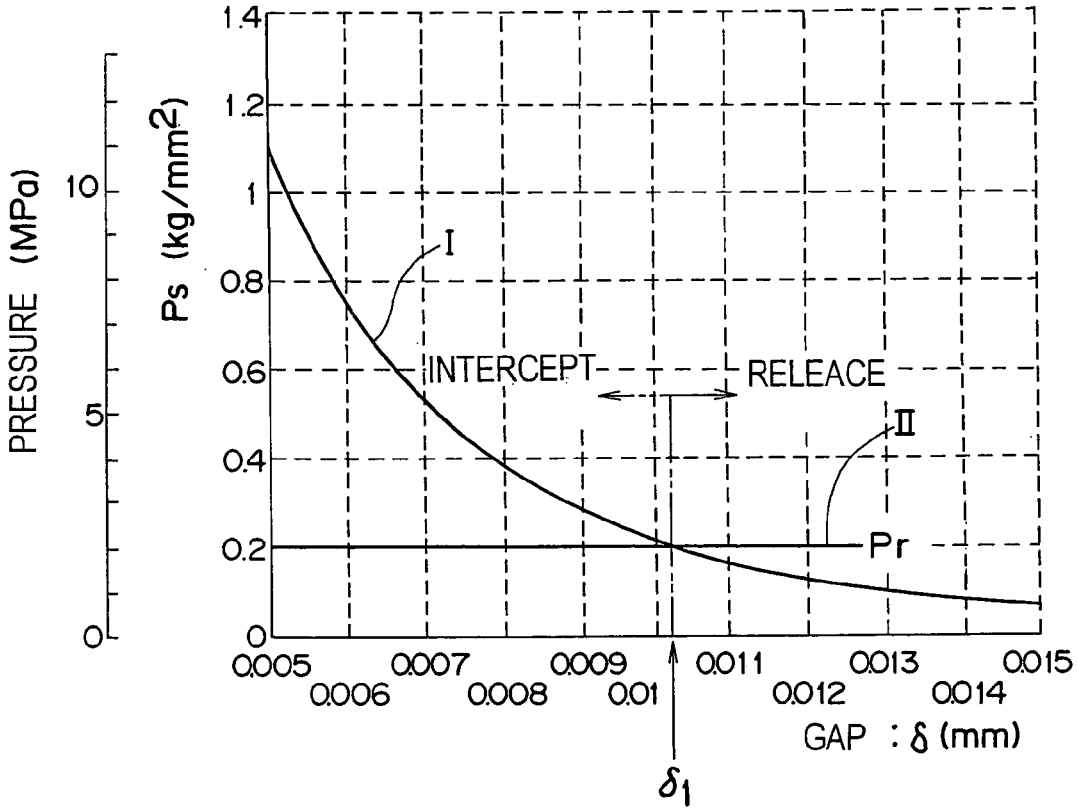
Figure 15:
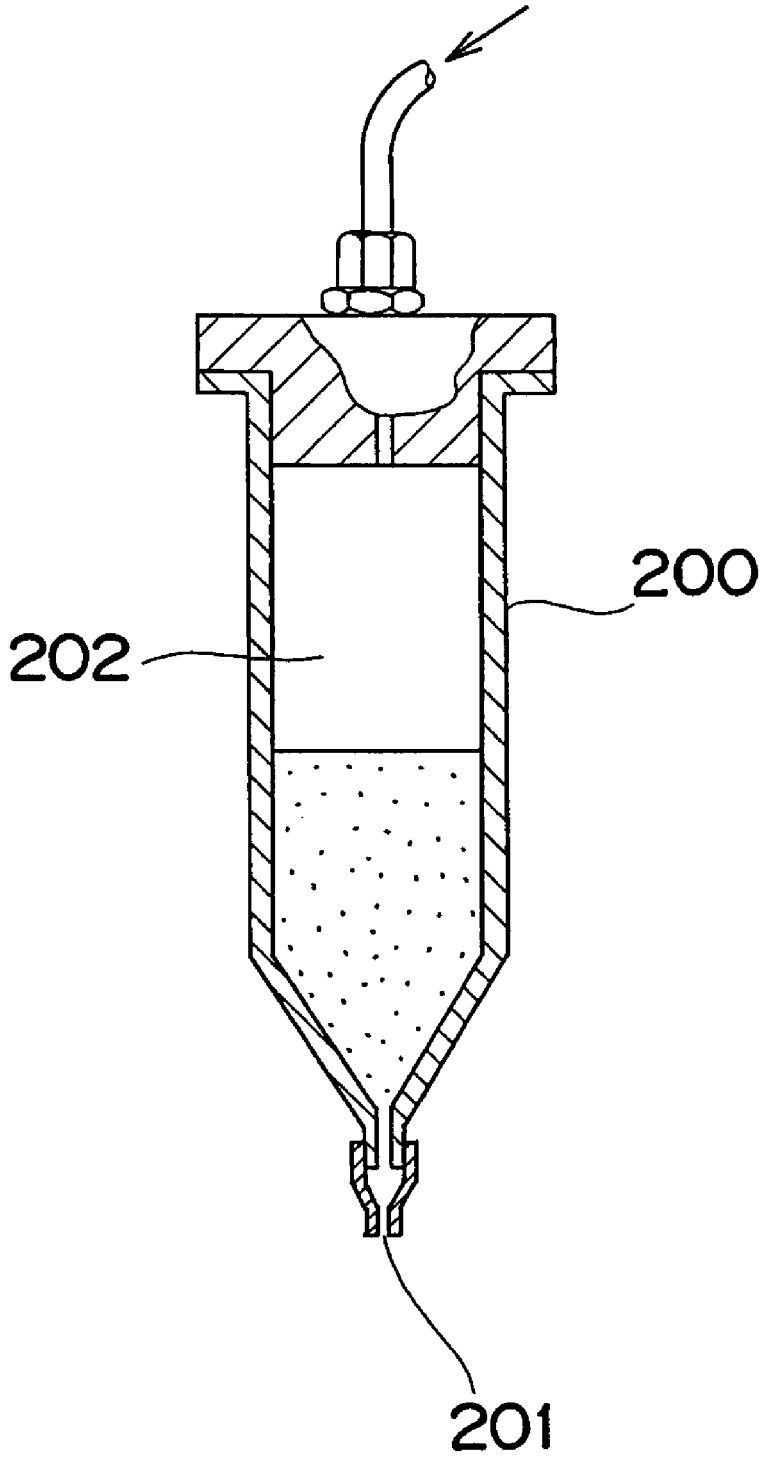
FIG. 15 is a view showing an air-pulse method in a conventional example.

A curve (1) in the graph of FIG. 14C shows characteristics of a seal pressure PS to a gap 5 in the case of using a spiral groove-type thrust groove under the conditions shown in Table 2 below. A curve (II) in the graph of FIG. 14C is an example showing the relation between a pumping pressure of the radial groove and the gap 6 at the top of the shaft in the case where axial flow is not present. Similar to the thrust groove, the pumping pressure of the radial groove is selectable in wide range by selection of a radial gap, a groove depth, and a groove angle. However, qualitatively, the pumping pressure Pr of the radial groove does not depend on the size of a space at the top of the shaft (i.e., the size of the gap δ).

TABLE 2

| Parameters | | Symbol | Setting values |
|---|---|---|---|
| Number of rotation | | N | 200 rpm |
| Viscosity coefficient of fluid | | μ | 10000 cps |
| Thrust groove for seal | Groove depth | hsg | 10 μm |
| | Radius | $r_o$ | 3.0 mm |
| | | $r_i$ | 1.5 mm |
| | Groove angle | αs | 30 deg |
| | groove width | bsg | 1.5 mm |
| | Ridge width | bsr | 0.5 mm |

Symbol $r_o$ denotes an outer diameter of the thrust bearing, and symbol $r_i$ denotes an inner diameter of the thrust bearing.

If the gap δ of the thrust groove is sufficiently large, e.g., the gap δ=15 μm, the generated pressure is as small as P<0.1 kg/mm$^2$.

An end face of a rotational shaft is approximated to a facing face on the fixed side while the shaft is being rotated. In the state of the gap δ<10.0 μm, the seal pressure becomes larger than the pumping pressure Pr of the radial groove, as a result of which outflow of fluid to the discharge port side is intercepted.

FIG. 2 stated before is a view showing the state that outflow of fluid is intercepted, in which fluid in the vicinity of the opening portion 39 of the discharge nozzle is subjected to pumping action in the centrifugal direction [arrow of FIG. 2] by the thrust groove 38, so that the pressure in the vicinity of the opening portion 39 becomes negative pressure (less than the air pressure). Due to this effect, the fluid remaining after interception in the discharge nozzle 13 is sucked again to the inside of the pump. As a result, a fluid mass due to surface tension is not generated at the end of the discharge nozzle, and therefore issues such as thread-forming and driveling may be solved.

In the embodiment of the present embodiment, moving the rotational shaft by as small as about 5 to 10 μm in the axial direction makes it possible to freely control the ON/OFF state of fluid discharge.

In summary, the present embodiment utilizes the point that seal pressure by the thrust groove rapidly increments as the gap δ becomes small, whereas pumping pressure of the radial groove is quite insensitive to the change of the gap δ.

It is noted that the radial groove and the thrust groove may be formed on either the rotational side or the fixed side.

Also, in the case of applying powder and granular material such as adhesives containing fine particles, the minimum value δmin of the gap δ may be set larger than fine particle size Ød as shown in the next equation (2).

$$\delta min > \text{Ød} \tag{2}$$

For obtaining a larger gap to the same developed pressure, the outer diameter of a thrust seal brim 31 is made large and appropriate values are selected for the groove depth, groove angle, and the like.

Described above is already disclosed in a former proposal.

Although the thrust dynamic seal is not an indispensable element for the present invention, the combination thereof with the present invention brings about the following effect.

More particularly, application process may be shifted from application process A to application process B while rotation of a motor is maintained and the intercepted state of fluid from the discharge nozzle is maintained.

Therefore, there is no lost time for termination and startup of the motor, thereby enabling further increase of production tact.

In the present embodiment, a giant magnetostrictive element is used for an axial driving apparatus. However, in the pump for handling a micro flow quantity, a necessary stroke for the gap δ for constituting "noncontact seal" is an order or maximum tens of microns, and therefore the limited stroke of an electro-magnetostrictive element such as giant magnetostrictive elements and piezoelectric elements does not cause an issue.

Further, in the case of discharging high-viscosity fluid, by the pumping action of the radial groove and the squeeze pressure, a large discharge pressure is expected to be generated. In this case, since a large thrust for resisting the high fluid pressure is required of the first actuator 1, an electro-magnetostrictive type actuator capable of easily outputting several hundred to several thousand N power is preferable. The electro-magnetostrictive element has a frequency response characteristic of several MHz or more, so that rectilinear motion of the main shaft can be performed with high responsibility. Consequently, a discharge quantity of high-viscosity fluid may be controlled with high accuracy and with high responsibility.

Also, in the case of using a giant magnetostrictive element for the axial driving apparatus compared to the case of using a piezoelectric element, a conduction brush may be omitted, which makes it possible to reduce a load of a motor (rotating apparatus) and to minimize the inertia moment of an operating portion since the entire constitution is extremely simplified, resulting in enabling downsizing of the dispenser.

In each of the embodiments of the present invention, an electro-magnetostrictive element is used for the axial driving apparatus. However, in the pump for handling a micro flow quantity, a necessary stroke for the gap δ for constituting "noncontact seal" is an order of maximum tens of microns, and therefore the limited stroke of an electro-magnetostrictive element such as giant magnetostrictive elements and piezoelectric elements does not cause an issue.

Further, in the case of discharging high-viscosity fluid, by the pumping action of the radial groove, a large discharge pressure is expected to be generated. In this case, since a large thrust for resisting against the high fluid pressure is required of the first actuator 1, an electro-magnetostrictive type actuator capable of easily outputting several hundred to several thousand N power is preferable. The electro-magnetostrictive element has a frequency response characteristic of several MHz or more, so that rectilinear motion of the main shaft can be performed with high responsibility. Consequently, a discharge quantity of high-viscosity fluid may be controlled at high accuracy with high responsibility.

Also, in the case of using a giant magnetostrictive element for the axial driving apparatus compared to the case of using a piezoelectric element, a conduction brush may be omitted, which makes it possible to reduce a load of a motor (rotating apparatus) and to minimize the inertia moment of an operating portion since the entire constitution is extremely simplified, resulting in enabling downsizing of the dispenser.

The method and apparatus of applying fluid using the present invention enable implementation of the following effects:

1. High-velocity discharge interception and start can be performed.

2. At the time of staring and terminating application, thinning and breaking of the initial point portion of a drawing line or thickening and pooling of the end point portion are not generated, so that an applying line with high accuracy may be drawn.

3. Troubles such as clogging of a flow passage due to compressive destruction of powder and characteristic change of fluid are not generated.

4. The pump of the present invention may also have the following characteristics:

① High-velocity application of high-viscosity fluid is available.

② An ultra-micro quantity of fluid may be discharged with high accuracy.

Applying the present invention to, for example, a dispenser for surface mounting, fluorescent substance application for PDP and CRT displays, application of seal materials of liquid crystal panel, and the like makes it possible to bring out advantages of the present invention in its fullness and therefore the effect thereof becomes profound.

Although the present invention has been fully described in connection with the preferred embodiments thereof with reference to the accompanying drawings, it is to be noted that various changes and modifications are apparent to those skilled in the art. Such changes and modifications are to be understood as included within the scope of the present invention, as defined by the appended claims, unless they depart therefrom.

The invention claimed is:

1. A method of applying fluid comprising:

feeding fluid by a fluid feeding apparatus to an area between two faces positioned so as to maintain a gap therebetween, wherein the gap between the two faces can be changed by driving an actuator in order to intermittently discharge the fluid to the area between the two faces;

providing an input signal in which a high-frequency component and a DC component are superimposed to drive the actuator for changing the gap between the two faces; and intermittently discharging the fluid located between the two faces for fluid application, wherein when a discharge time in the intermittent discharge process is expressed as T, an integral value of a discharge flow quantity of the fluid in a section of the discharge time T is expressed as Qsum, and an average discharge flow quantity Qave of the fluid is defined as Qave=Qsum/T, the actuator is driven so that the average discharge flow quantity Qave is set, by adjusting a duty ratio, a pulse density of the pulse waveform, a frequency of the pulse waveform, or an amplitude of the pulse waveform when an input the pulse waveform, or an amplitude of the pulse waveform when an input waveform of the high-frequency component is approximated to a pulse waveform, or an envelope pattern of the high-frequency component in initial and end points of the fluid application.

2. The method of applying fluid as claimed in claim 1, wherein when the gap between the two faces are changed by driving the actuator, a shaft of an electro-magnetostrictive element is moved forward and backward in an axial direction toward a housing, which serves to house the shaft and has the discharge port, so as to discharge the fluid from the discharge port.

3. The method of applying fluid as defined in claim 1, wherein the high-frequency component is in a range of from 50 Hz to 3000 Hz.

4. A method of applying fluid comprising:

feeding fluid by a fluid feeding apparatus to an area between two faces disposed so as to maintain a gap therebetween;

intermittently discharging the fluid disposed between the two faces by changing the gap so that the fluid between the two faces is discharged for fluid application, wherein the gap is changed by driving an actuator;

applying the fluid while relatively moving a discharge port formed between the two faces and a substrate facing the discharge port; and when a velocity of the relative movement of the substrate and the discharge port is referred to as V, and a frequency for changing the gap between the two faces is referred to as f, selecting the velocity V and the frequency f so as to make a drawing line, that is applied on the substrate during the intermittent discharging operation, in the form of a pseudo-continuous line.

* * * * *